US009428332B2

(12) United States Patent
Supple

(10) Patent No.: US 9,428,332 B2
(45) Date of Patent: Aug. 30, 2016

(54) OUTDOOR TRASH CONTAINER WITH BAG HOLDER

(71) Applicant: Audrey A. Supple, Brooklyn, NY (US)

(72) Inventor: Audrey A. Supple, Brooklyn, NY (US)

( * ) Notice: Subject to any disclaimer, the term of this patent is extended or adjusted under 35 U.S.C. 154(b) by 0 days.

(21) Appl. No.: 14/804,223

(22) Filed: Jul. 20, 2015

(65) Prior Publication Data

US 2016/0016730 A1 Jan. 21, 2016

Related U.S. Application Data

(60) Provisional application No. 62/026,686, filed on Jul. 20, 2014.

(51) Int. Cl.
*B65F 1/06* (2006.01)
*B65F 1/14* (2006.01)

(52) U.S. Cl.
CPC ..... *B65F 1/1484* (2013.01); *B65F 1/06* (2013.01); *B65F 1/141* (2013.01); *B65F 1/1646* (2013.01)

(58) Field of Classification Search
CPC .... B65F 1/1484; B65F 1/1421; B65F 1/141; B65F 1/1646; B65F 1/16; B65F 1/06
USPC ..... 220/908.1, 908, 495.06, 495.01, 495.08
See application file for complete search history.

(56) References Cited

U.S. PATENT DOCUMENTS 4,953,740 A * 9/1990 Koda ..... B65F 1/06 220/263
D328,169 S 7/1992 Burleigh
5,253,777 A * 10/1993 Schutz ..... B29C 70/345 206/386
D374,528 S 10/1996 Zackson et al.
D393,510 S 4/1998 Creske
6,176,388 B1 1/2001 Orndorff
6,206,183 B1 * 3/2001 Helsel ..... A47B 97/08 206/1.7
D507,687 S 7/2005 Moon et al.
D545,023 S 6/2007 Weiss
D561,966 S 2/2008 Skalka
D566,921 S 4/2008 Skalka
D594,621 S 6/2009 Tuncel
D644,391 S 8/2011 Kopp et al.
D655,473 S 3/2012 Moore
D681,302 S 4/2013 Moore
D727,584 S 4/2015 Busch
2006/0261072 A1 * 11/2006 Diep ..... B65F 1/062 220/495.07
2008/0264948 A1 * 10/2008 Kovacevich ..... B65D 25/16 220/495.08
2010/0219192 A1 * 9/2010 Quan ..... B65F 1/163 220/495.08
2012/0181282 A1 * 7/2012 Heller ..... B65D 25/16 220/495.08
2012/0279123 A1 * 11/2012 Rajagopalan ..... A01G 9/021 47/65.7
2013/0075406 A1 * 3/2013 Sakaguchi ..... B65F 1/06 220/495.08
2013/0105488 A1 * 5/2013 Quan ..... B65F 1/06 220/495.08
2014/0231435 A1 * 8/2014 McCabe ..... B65F 1/06 220/495.08

* cited by examiner

*Primary Examiner* — King M Chu
(74) *Attorney, Agent, or Firm* — Troutman Sanders LLP

(57) ABSTRACT

The present invention relates to outdoor trash containers including motifs and/or details that can be attached or detached from the base or lid of the trash container to allow for customization of the container. The present invention also includes a bag holder within the container to stabilize a trash bag within the container.

10 Claims, 16 Drawing Sheets

Fig. 17A
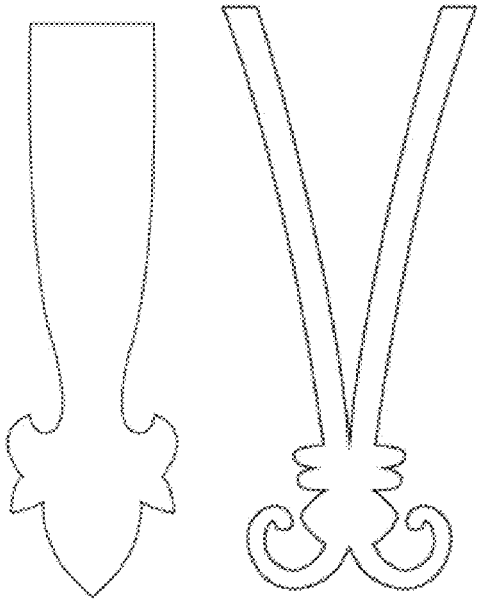
Fig. 17B
Fig. 18A
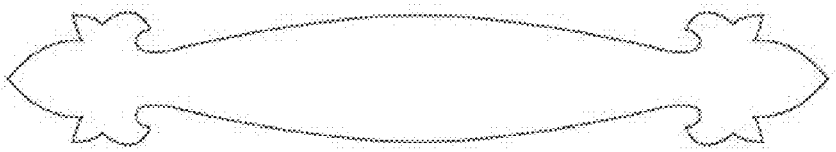
Fig. 18B
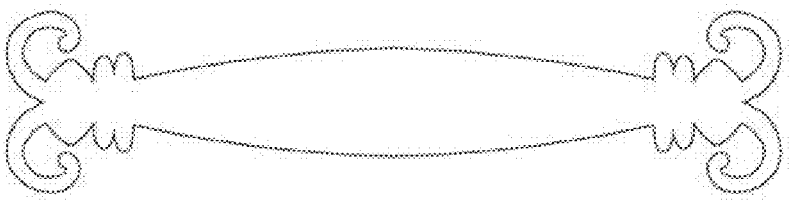

OUTDOOR TRASH CONTAINER WITH BAG HOLDER

CROSS-REFERENCE TO RELATED APPLICATIONS

This application claims priority to U.S. Provisional Application No. 62/026,686 filed Jul. 20, 2014, which is incorporated herein by reference.

FIELD OF THE INVENTION

The present invention relates to outdoor trash containers, and more particularly, containers designed to be personalized while providing greater functionality in waste storage and removal.

BACKGROUND

Although trash containers, or garbage cans, are utilized by a majority of residential and commercial property owners, the number and types of trash containers that are commercially available for outdoor use generally illustrate the same consistent problems. There is a need for ergonomically correct residential garbage cans with architectural details that are compatible with historic homes. The unsightliness of our curbsides is not addressed by the currently available commercial options.

Trash containers are currently wrought with aesthetic and customization issues. Such issues become more readily viewable when multiple containers are placed together in populated residential areas. Major issues and problems involved with the aesthetics of currently available trash containers include that they are not attractive or appealing, the color choices are not cohesive with the curb appeal of many residential areas, and the containers often look misplaced or stand out more than some residential structures. These issues create more issues such as decreased waste awareness, reduced civic pride, and embarrassment or shame towards one's own containers. Trash containers that are not appealing are continuously produced due to the price sensitivity and competition aspects of creating and selling such containers.

There is a need for personalization of trash containers. There is a need for trash containers that are architecturally compatible with residential areas and provide better curb appeal and "streetscape." There is also a need for urban color choices that allow the containers to remain attractive but not intrusive. Solving these problems can help to increase waste awareness and civic pride.

Common examples of outdoor trash containers include round, cylindrical containers with opposing handles on the top opening of the cylindrical shape. Such examples can also include separate, round lids meant to fit the opening of the cylindrical container.

While the aforementioned containers provide basic ease in the storage of waste, the shape lacks personalization and customization, aesthetic appeal, and does not provide adequate support or integrity to waste storage. In particular, such containers may be stolen or easily overturned by strong winds, animals, or people, causing the container to roll into streets, sidewalks, or other properties. Additionally, due to the round shape of the opening, lids cannot be adequately anchored or attached to the container, often resulting in separation of the lid from the container. Cylindrical containers are also not an efficient shape for conserving space between containers.

There is a need for an outdoor trash container that can be appropriately anchored to one's property. There is also a need for such a container to have a space-efficient shape, allowing for consecutive placement, without wasted space between containers. The lids of such containers should be attached to the container and must be relatively easy to lift open.

Additional examples of available trash containers are non-cylindrical trash containers with an attached lid. However, these containers still do not provide for a method of anchoring the container to one's property in order to prevent the container from being stolen or overturned. Such containers may be more easily placed in a consecutive pattern, compared to cylindrical containers, however, they still do not provide for minimal wasted space between containers.

In each of the above examples, owners may sometimes write their address or other information on the container in order to properly identify the container. There is a need for attachable details that may be able to serve personalization, customization, and identification purposes while also upholding the appearance of the container.

Existing trash containers are typically solid, plastic, or metal containers, without the ability to be easily cleaned. Waste buildup can cause trash containers to look and smell dirty, ruining the appeal of the containers. There is a need for a container that allows for easy cleaning in order to preserve the appeal of the container.

Existing trash containers also provide various additional problems such as an inefficient shape, which causes spacing issues. Existing shapes may cause the containers to roll around or get knocked over easily. There is a need for a container that allows for greater stability and space efficiency.

Trash containers can also have lids that are dirty or difficult to handle. Such lids are sometimes separate from the container. There is a need for a container with an attached lid that is easy to lift. A lid that is easy to lift allows for a more cleanly experience. Additionally, an attached lid prevents the risk of rodents or insects.

In order to prevent a trash container from becoming knocked over or stolen, there is also a need for a security measure which can allow for stability and long-term placement of a trash container. There is a need for this security measure to be hidden, one reason being to preserve the aesthetic appeal of the container.

Naturally, trash containers can also become quite dirty. Typically, a container may be cleaned and may then be turned on its side to allow for drainage of dirty water, fluids, or trash from the opening of the container. There is a need for a container with an easier method of draining water or other liquids that may accumulate in the bottom of a trash container.

Often there are trash bags placed within trash containers to allow for collection of trash or other smaller bags of trash. Such bags are typically placed with the bag opening over and around the top of a trash container. This is unsightly and prevents the container from having any aesthetic appeal. Such placement of the bag can cause the bag to dislodge from the opening of the trash container and fall into the container. There is a need for a bag holder which can hide the trash bag within the trash container, allowing the container to remain appealing while keeping the bag secure within the container. Such a holder may prevent the bag from becoming dislodged from the container.

Some trash containers can require a large amount of shipping space. Transfer and shipping of such containers can be difficult. There is a need for a container that can be easily shipped. There is also a need for a container than can be easily disassembled and/or reassembled.

SUMMARY OF THE INVENTION

As specified in the Background section, there is a great need in the art for a trash container that can be customizable for utility and compatibility with the aesthetics of a residence and to allow for greater security and ease in waste disposal.

The present invention provides a trash container, said container including: a front wall, left and right side walls, a back wall, and a floor panel, said walls and panel configured to create a base with an interior chamber; a top opening to the interior chamber; a lid connected to the base, said lid being configured to pivot into a closed configuration covering the opening to the interior chamber, or an open configuration allowing access to the interior chamber; and one or more detachable motifs attached to one or more walls of the base, or the lid. In certain examples, one or more motifs are attached to the front wall of the base, and may be permanently attached to the base.

The present invention also provides the above container including one or more hinge details attached to the lid, or one or more handle details attached to the lid.

The present invention also provides a trash container, including; a front wall, left and right side walls, a back wall, and a floor panel, said walls and panel configured to create a base with an interior chamber; a top opening to the interior chamber; a lid connected to the base, said lid being configured to pivot into a closed configuration covering the opening to the interior chamber, or an open configuration allowing access to the interior chamber; a bag holder placed within the top opening of the interior chamber, providing an interior area in the top opening which allows access to the interior chamber of the base; a holder handle extending from the bag holder and configured to rest on the base; and a holder bracket extending from the bag holder and configured to connect to the base; wherein the bag holder allows for a trash bag to be secured in the interior chamber and over the bag holder. The bag holder may be connected to the base and configured to allow the bag holder to pivot into open or closed configurations.

The present invention also provides a trash container including: a base with an interior chamber; a top opening to the interior chamber; a lid connected to the base, said lid being configured to pivot into a closed configuration covering the opening to the interior chamber, or an open configuration allowing access to the interior chamber; one or more feet extending from the base; one or more bumpers on each foot; wherein the bumpers allow for alignment where one or more containers are placed next to each other. The container may also include one or more openings in the floor panel of the base wherein the floor panel is configured to allow drainage of fluids or debris through the openings. The container may also include one or more openings for securing the container to a fixed location, or one or more screws for securing the container to a fixed location.

The present invention also provides a trash container including: a base with an interior chamber; a top opening to the interior chamber; a lid connected to the base, said lid configured to pivot into open or closed configurations; one or more detachable motifs attached to the base; one or more detachable handle and/or hinge details attached to the lid; a bag holder placed within the top opening of the interior chamber, providing an interior area in the top opening which allows access to the interior chamber of the base, wherein the bag holder allows for a trash bag to be secured in the interior chamber and over the bag holder; and one or more bumpers attached to one or more feet of the base, wherein the bumpers allow for alignment of one or more containers. The container may also include a floor panel of the base configured to allow for drainage. The container may also include a screw for securing the container to a fixed location.

Additional examples and advantages of the invention will be set forth in part in the description which follows, and in part will be obvious from the description, or may be learned by practice of the invention. The examples and advantages of the invention will be realized and attained by means of the elements and combinations particularly pointed out in the appended claims. It is to be understood that both the foregoing general description and the following detailed description are exemplary and explanatory only and are not restrictive of the invention as claimed.

BRIEF DESCRIPTION OF THE DRAWINGS

This invention is described with particularity in the following description and figures. The above and further aspects of this invention may be better understood by referring to the following description in conjunction with the accompanying drawings, in which like numerals indicate like structural elements and features in various figures. The drawings are not necessarily to scale, emphasis instead being placed upon illustrating the principles of the invention.

The drawing figures depict one or more examples in accord with the present teachings, by way of example only, not by way of limitation. In the figures, like reference numerals refer to the same or similar elements.

FIG. 10A shows the lid and bag holder in open configurations. FIG. 10B shows the bag holder in a closed configuration.

FIGS. 17A-B are examples of hinge details of the present invention.

FIGS. 18A-B are examples of handle details of the present invention.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

Examples of the invention are described herein below with reference to some of the figures.

The present invention relates to a trash container or can, which is a container for temporarily storing waste, and is usually made out of metal or plastic. Common terms may be dustbin, rubbish bin, litter bin, garbage can, trash can, trash bin, dumpster, waste basket, waste paper basket, waste receptacle, container bin, bin and kitchen bin.

Figure 1:
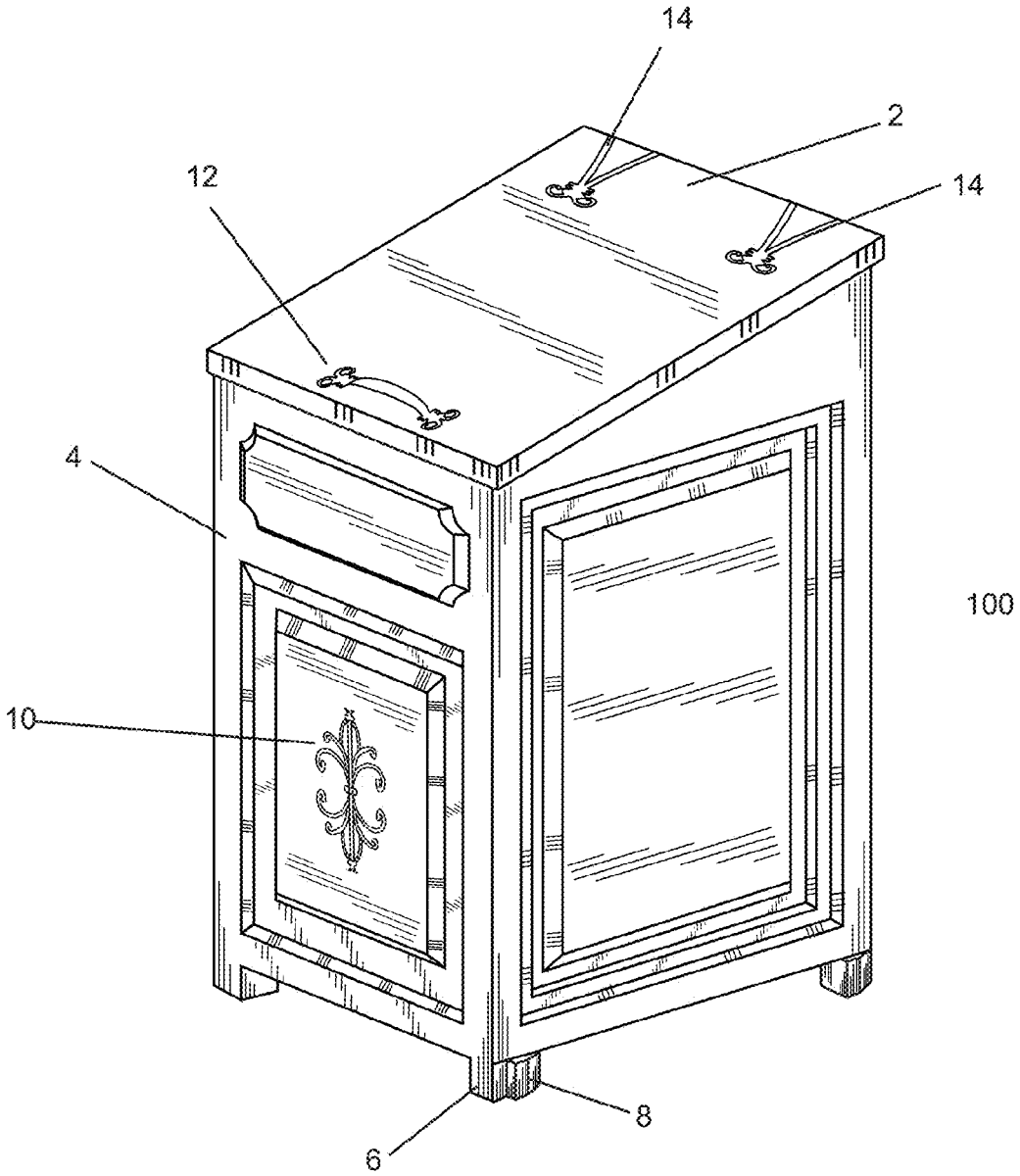
FIG. 1 is a perspective view of an example of the present invention showing the lid in a closed configuration and showing the motif, hinge, and handle details attached.

FIG. 1 illustrates an example of a trash container according to the present invention. In this example, the trash container is made up of a base 4 and a lid 2. The base includes a front wall, a left side wall, a right side wall, a back wall, and a floor panel. The walls and floor panel are configured to create an interior chamber. The base also includes a foot 6 on each corner of the floor panel. Each foot may also include a bumper 8. In the closed configuration, the lid prevents access to the interior of the trash container. The base and/or lid can be formed of, but not limited to, a suitable plastic such as polyethylene. The base and/or lid can be formed through, but not limited to, a molding process, such as rotational molding, injection molding, blow molding, etc. The container includes a motif 10, or decorative detail, that may be attached to the front of the base of the container. The container also includes hinge details 14 and/or a handle detail 12 that may be attached to the lid of the container. The motif, handle, and/or hinge details may be detachable to allow for attachment of different types of motif, handle, and/or hinge details.

Figure 5:
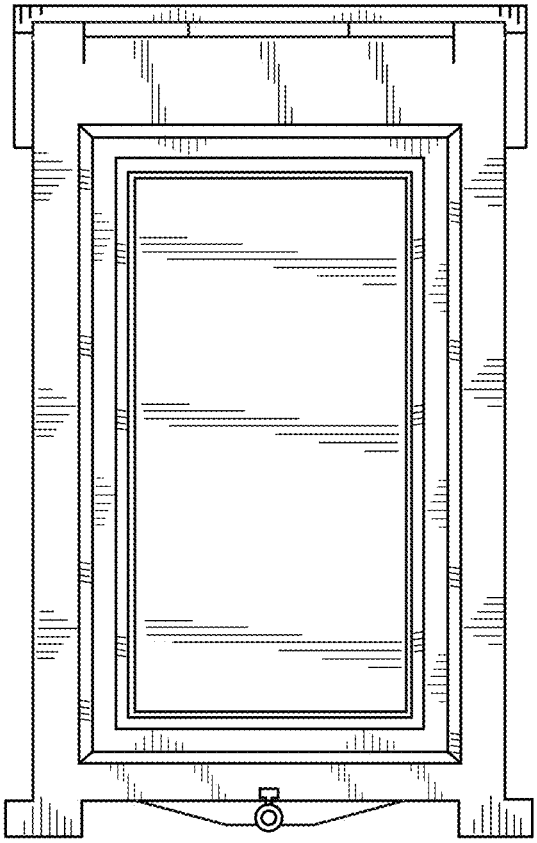
FIG. 5 is a back view of another example of the present invention.
Figure 10B:
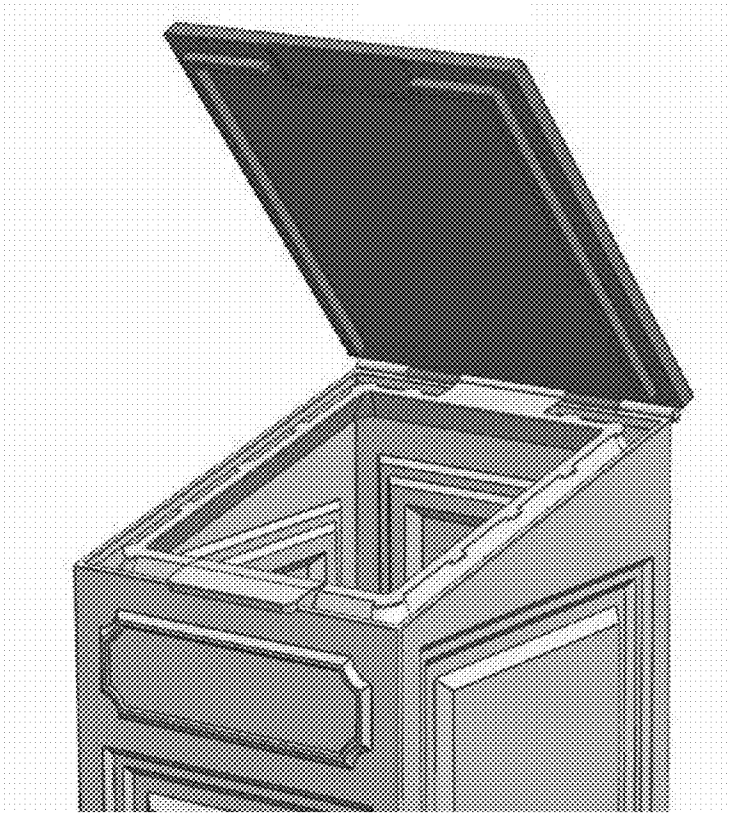
FIG. 10A-B are magnified, perspective views of yet another example of the present invention.
Figure 10A:
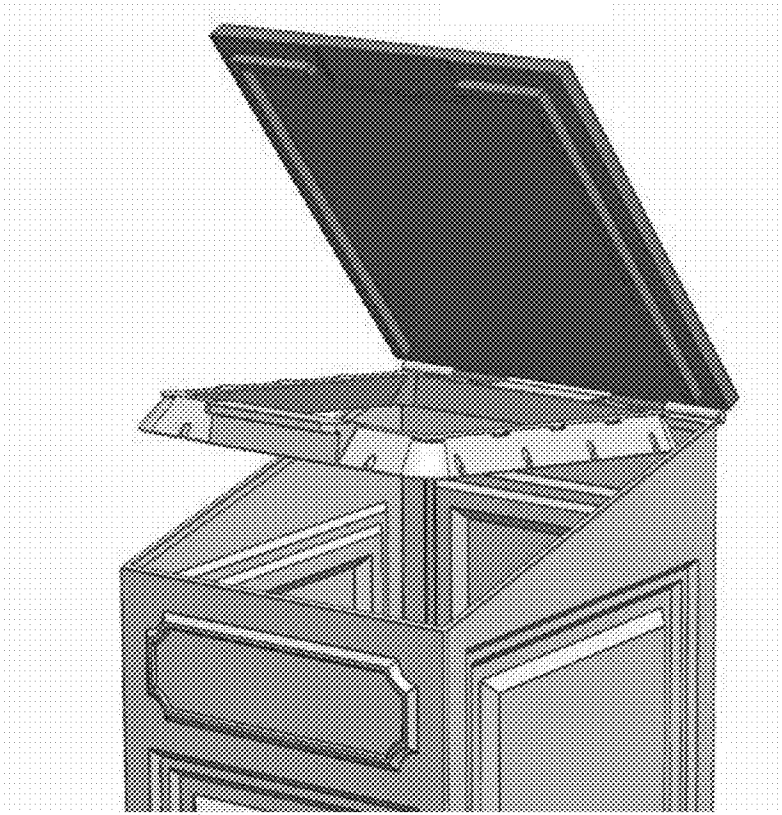
Figure 11:
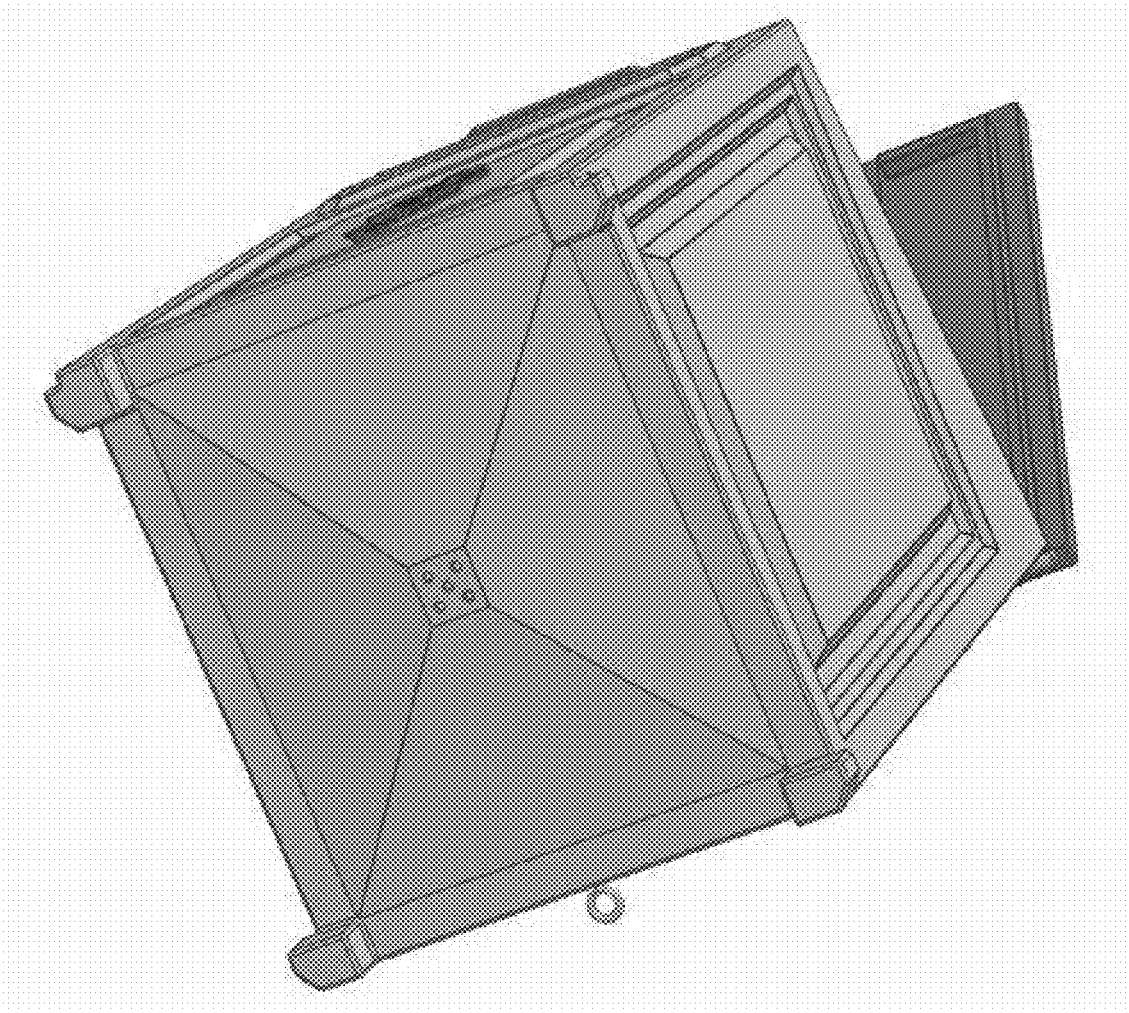
FIG. 11 is a bottom perspective view yet another example the present invention.
Figure 12:
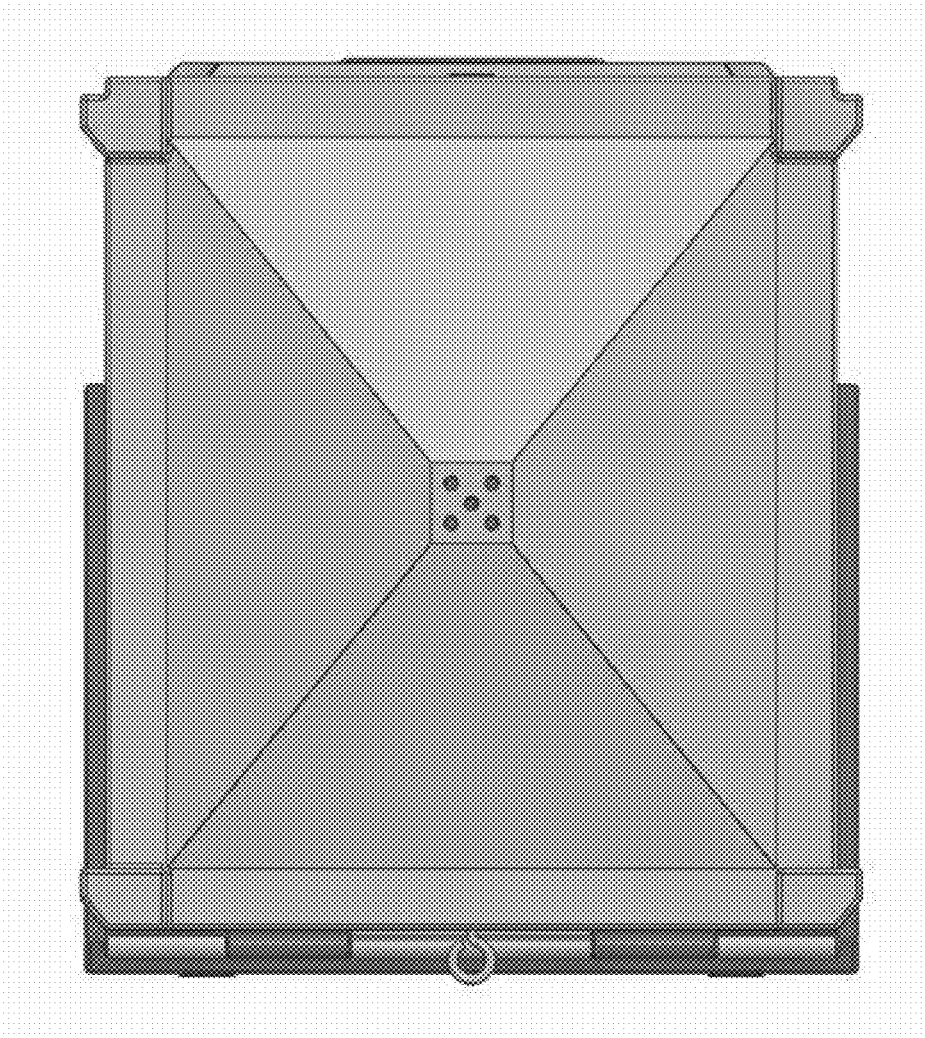
FIG. 12 is a bottom view of yet another example of the present invention.

As shown in FIG. 5, the back wall may contain a security screw (as also shown in FIGS. 10-12), which can be used to secure a chain or rope to the trash container. The lid may connect to the base through a hinge assembly. In another example, any wall or foot of the base may include a security screw to secure a chain or rope. In another example, the base of the container may include a hole or screw to be used in securing the container to a fixed location.

In another example of the invention, the base of the container includes an opening. The opening may be external and does not provide access to the interior chamber of the container. The opening may be used to allow a connection such as a rope or a chain, to be run through the opening and attached to a separate, external anchoring structure, such as a fence or the ground. The placement of the rope or chain allows for the container to be secured to the anchoring structure, preventing removal of the container.

Figure 2:
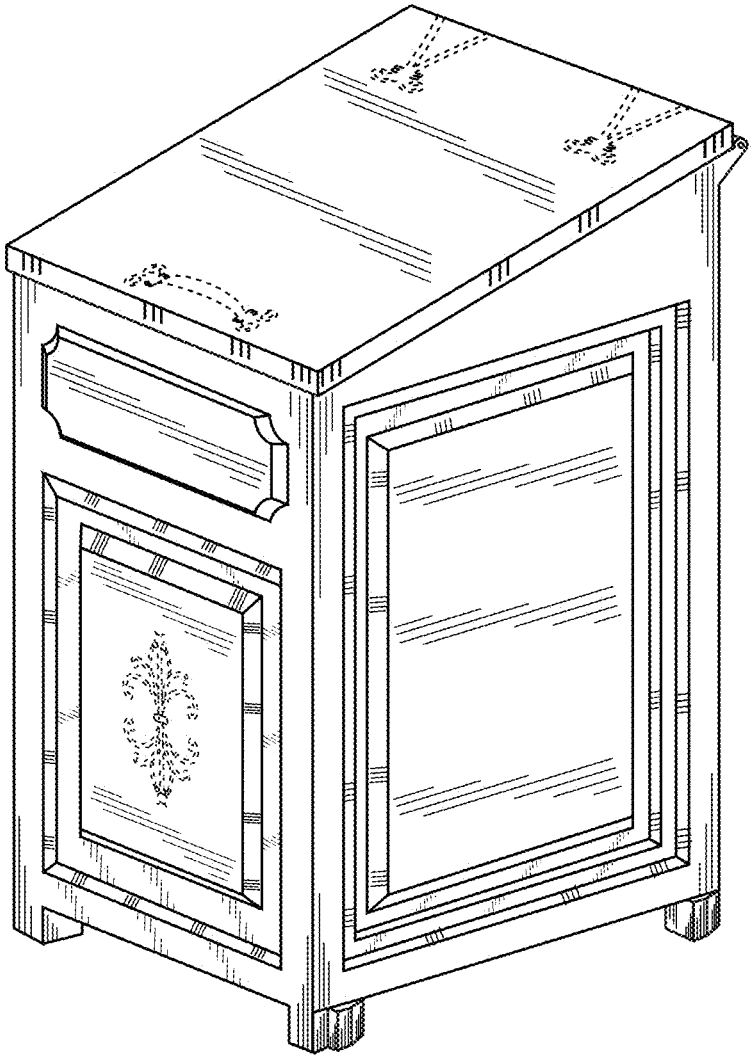
FIG. 2 is a perspective view of another example of the present invention.
Figure 6:
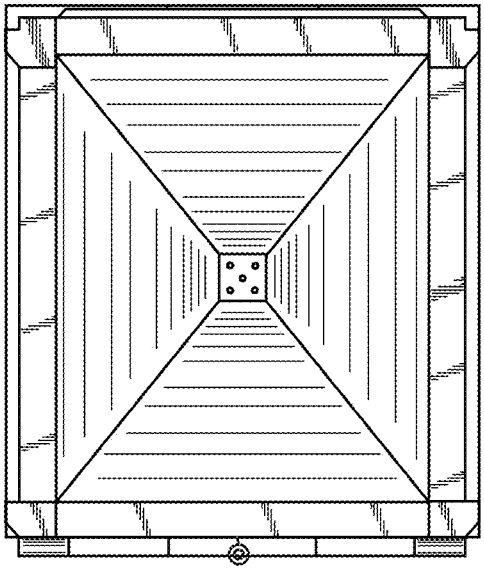
FIG. 6 is a bottom view of another example of the present invention.
Figure 13:
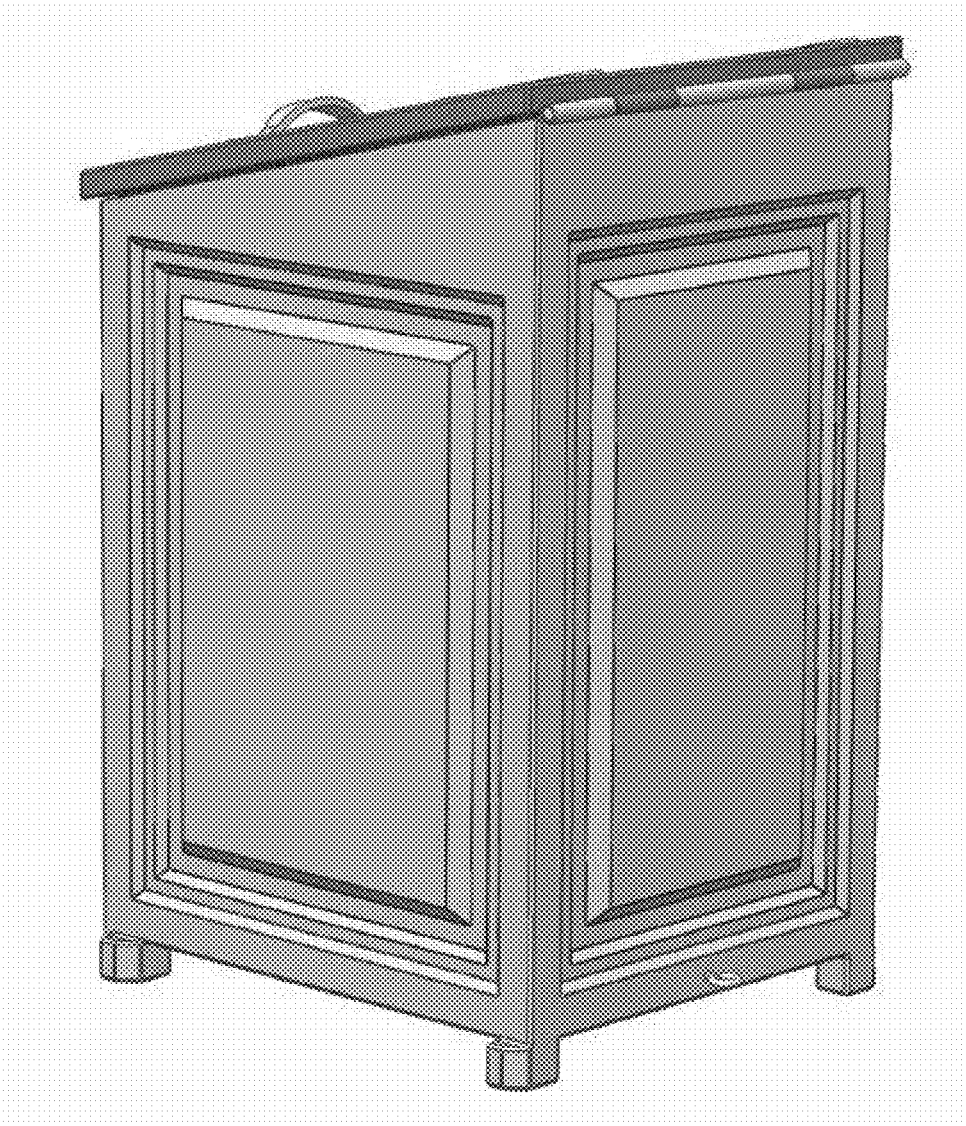
FIG. 13 is a back perspective view of yet another example of the present invention, in which the lid is in a closed configuration.
Figure 14:
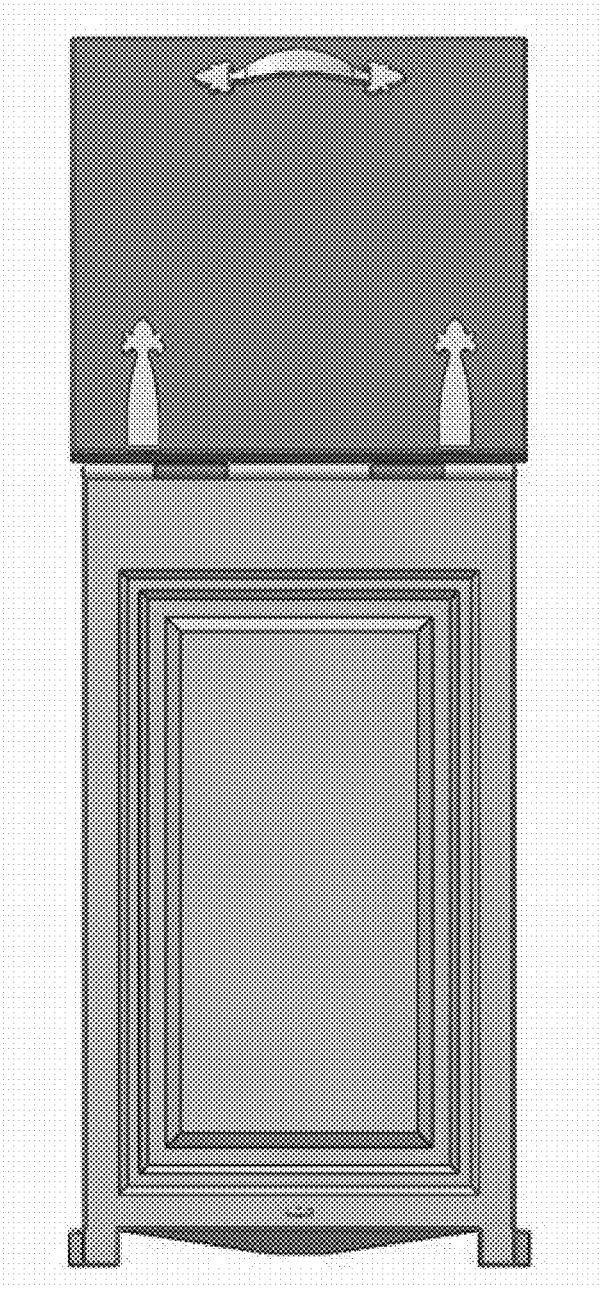
FIG. 14 is a back view of yet another example of the present invention, in which the lid is in an open configuration.

As illustrated in FIGS. 1, 2, and 6, each foot on the base of the container may include a bumper 8. The bumper allows for proper spacing and alignment between multiple containers when the containers are placed next to each other. The bumper may have a thickness approximately equal to the overhang of the lid over the side of the base. The outer face of the bumper may be positioned such that it is in the same plane as the outside of the lid. The bumper can also be seen in FIGS. 11-13.

Figure 7:
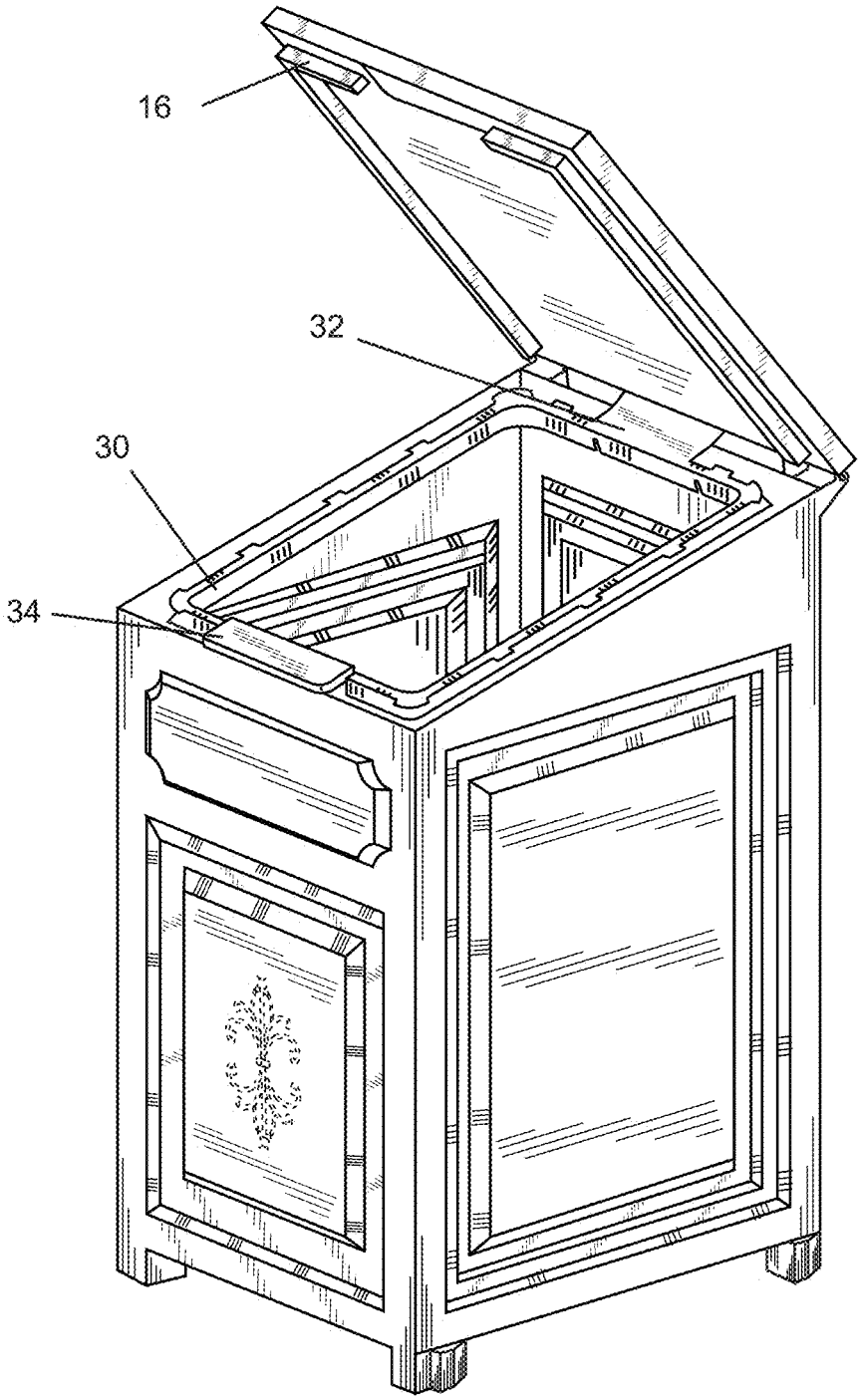
FIG. 7 is a perspective view of another example of the present invention showing the lid in an open configuration.

FIG. 7 illustrates an example of the trash container according to the present invention, in which the container's lid is in an open configuration. In this view, the trash container includes the base 4, the lid 2, and a bag holder 30. The base, lid, and holder are connected at a hinge which defines an axis along the top of the base. FIG. 7 illustrates the hinge axis defined along the top of the back wall of the base. One or more base brackets, extend outwardly from the top edge of the back wall of the base and include openings configured to receive a pin, or bar, along the axis of the hinge. One or more lid brackets extend from the lid and include openings configured to receive the pin, allowing the lid to pivot into an open or closed configuration. A holder bracket 32 extends from the holder and is configured to receive the pin, allowing the holder to also pivot into an open or closed configuration between the lid and the base. FIG. 7 illustrates an example in which the lid is in an open position and the holder is in a closed position.

A single pin or bar extending through all hinge brackets may allow for increased stability. The hinge may be configured such that the pin can be removed, allowing the lid and/or bag holder to be removed from the container. In other examples, the bag holder may be removed if not needed.

In additional examples of the present invention, the walls of the base are connected together with a hinge assembly. In these examples, the hinge defines an axis along the corner edges of the base.

The bag holder, or bag horn, described above may allow for a trash bag to be placed within the interior of the base. In a closed configuration, the holder provides an interior area in the opening of the base which allows access to the interior chamber of the base. A trash bag may be placed within the interior area of the holder and into the interior chamber of the base. The opening of the trash bag may be wrapped over the holder in manner which places the outer opening of the trash bag between the holder and the base. The holder may include tabs on the outer edges of the holder to aid in guiding and/or securing the bag between the holder and the walls of the base.

Figure 9:
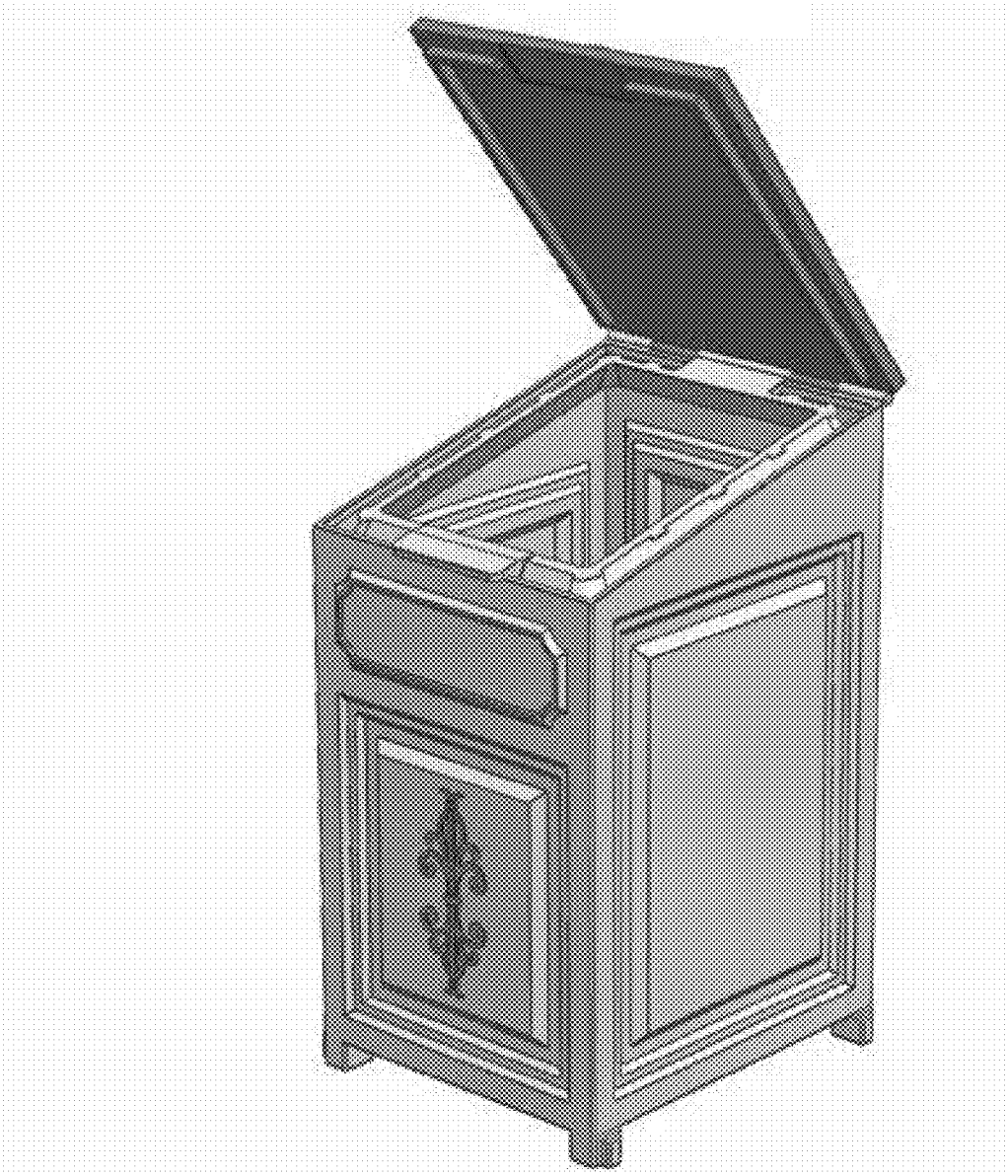
FIG. 9 is another front perspective view of yet another example of the present invention showing the lid is in an open configuration.

As illustrated in FIG. 7, the holder (or bag horn) 30 may also include a holder handle 34 placed in a position opposite to the hinge bracket 32 of the holder. The holder handle extends outward from the holder and may rest on the top of the front wall of the base. When the holder is in a closed configuration, the holder handle rests on the base and allows the holder to remain in a position parallel to the lid, in the same plane or parallel to the plane of the opening of the base. FIG. 9 shows yet another example of the present invention in which the lid is open and the bag holder is in a closed configuration. FIG. 10A illustrates the bag holder in an open configuration. FIG. 10B illustrates an example of the bag holder in a closed configuration.

The holder handle may be used to lift the holder into an open configuration. If a trash bag is wrapped over the holder, moving the holder into an open configuration allows for the bag to be released from the holder. The bag may then be removed from the container.

As illustrated in FIG. 7, the underside of the lid may also include additional molding 16 such that the molding fits into a space between the holder and the base when the lid is in a closed configuration. The additional molding provides greater stability of the lid and allows for greater sealing of the lid to the container. The molding allows for sealing of trash and/or smells within the container and sealing of animals and/or insects out of the container.

When in a closed configuration, the lid covers the holder and opening of the base. FIG. 1 shows an example of the present invention. The back wall of the base is taller than the front wall of the base, allowing the lid to rest in a slanted position from the back wall to the front wall. Such a position can allow for water or debris to fall from the lid, preventing the lid from becoming dirty.

In an example in which the back wall of the base is taller than the front wall of the base, when in an open configuration, the area of the opening of the base is larger than the area at a cross-section of the base. A greater area of the opening of the base allows for easier placement of trash within the container.

Figure 3:
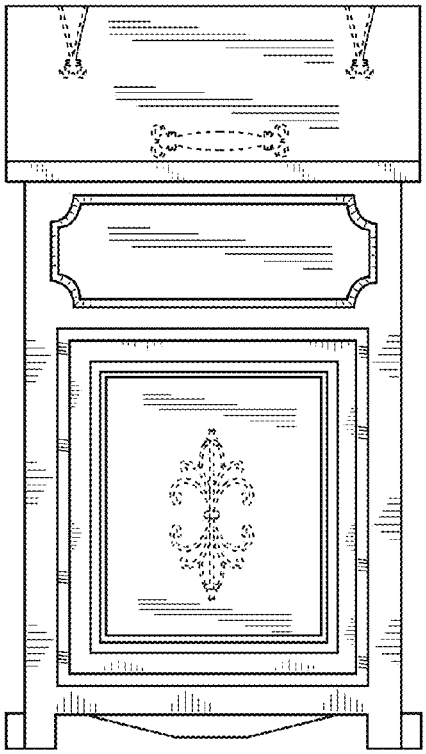
FIG. 3 is a front view of another example of the present invention.
Figure 4:
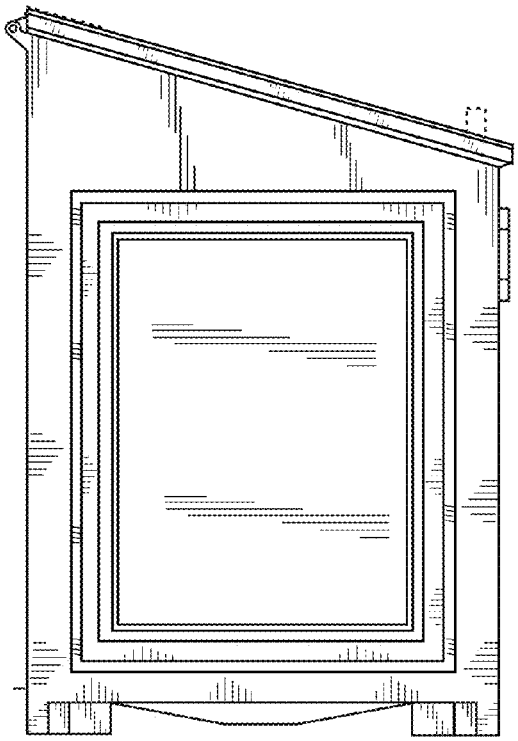
FIG. 4 is a side view of another example of the present invention.

FIG. 3 illustrates the front view of another example of a trash container according to the present invention. The front panel of the base includes an upper decorative area and a lower decorative area. The upper decorative area may be a raised portion of the front panel on which decorative details may be attached. The lower decorative area is another portion of the front panel on which motifs may be attached for customization.

Figure 16A:
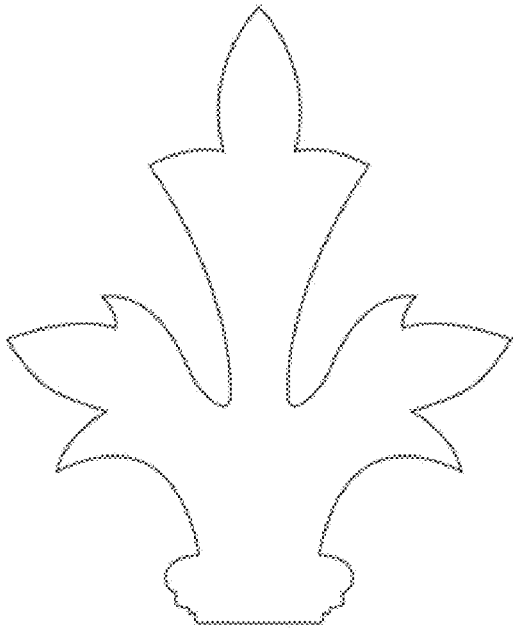
FIGS. 16A-B are examples of motifs of the present invention.
Figure 16B:
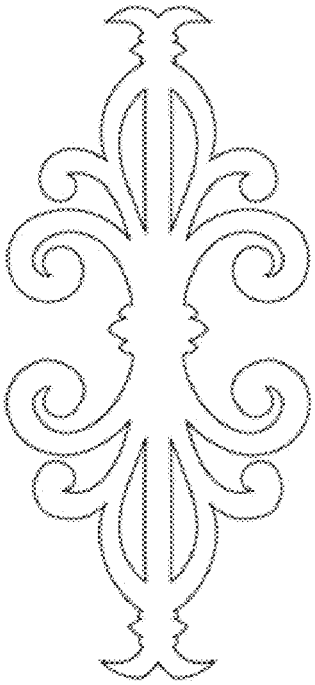

In other examples of the present invention, various openings may be included on the front wall of the container to allow for attachment of a motif. Such a detail may include a prong or tab that can be received by an opening on the wall of the container. The prong or tab can be inserted into the opening, allowing for the detail or motif to remain in a secured location on the front of the container. The detail can be designed and attached to allow for personalization and identification of the container. The detail or motif designs can include many different forms such as a fleur-de-lis, curly cues, bricks, grapes and garlands, letters, numbers, etc. In certain examples of the present invention, the openings on the wall are in a singular configuration that allows for placement of many different designs but with the same configuration for placement. FIG. 1 illustrates an example of the present invention in which a curly cue detail is placed on the lower decorative area of the front wall. FIGS. 16A-B illustrate various examples of motifs, or decorative details, that may be attached to the base or lid of the container.

Figure 8:
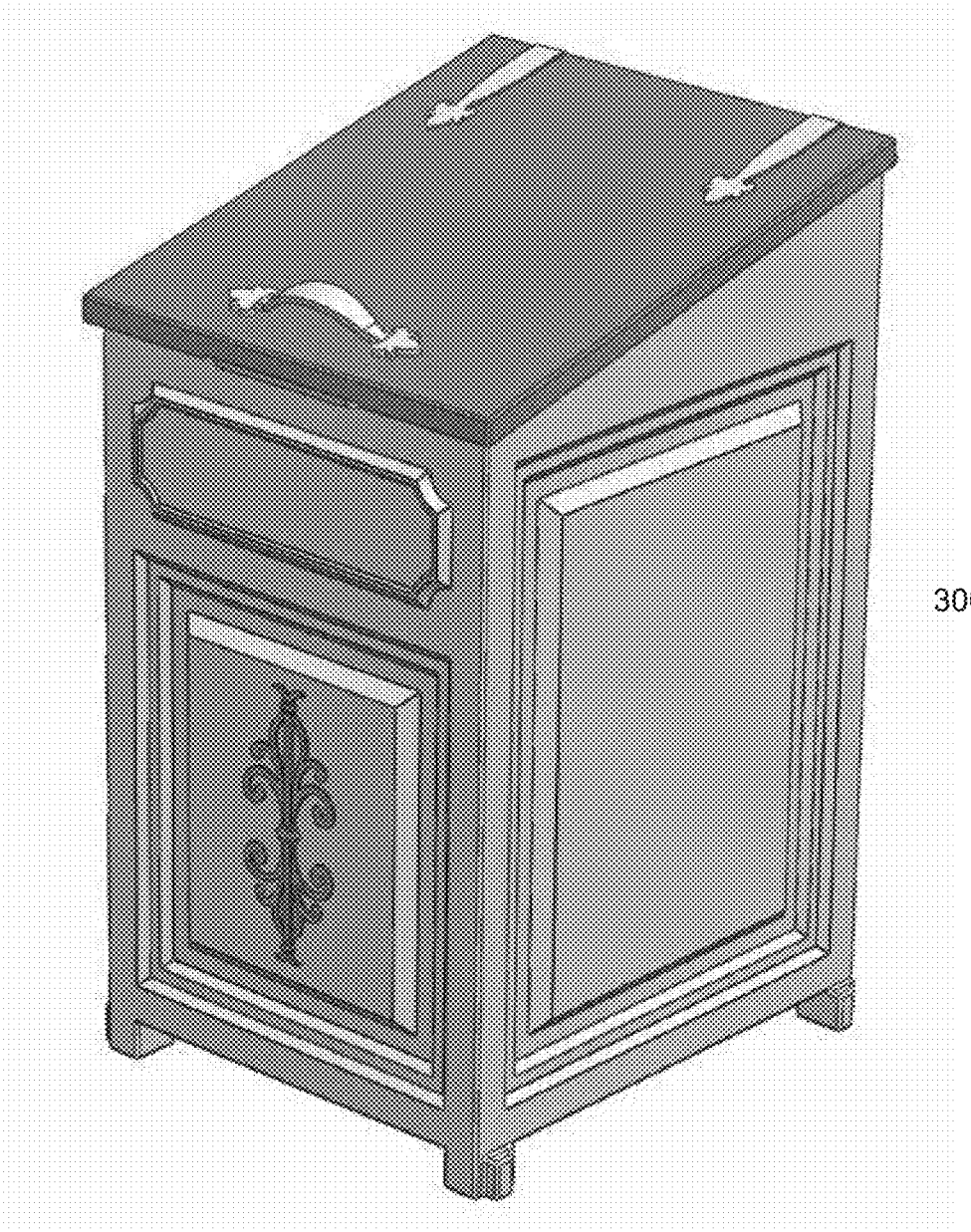
FIG. 8 is a front perspective view of yet another example of the present invention.
Figure 15:
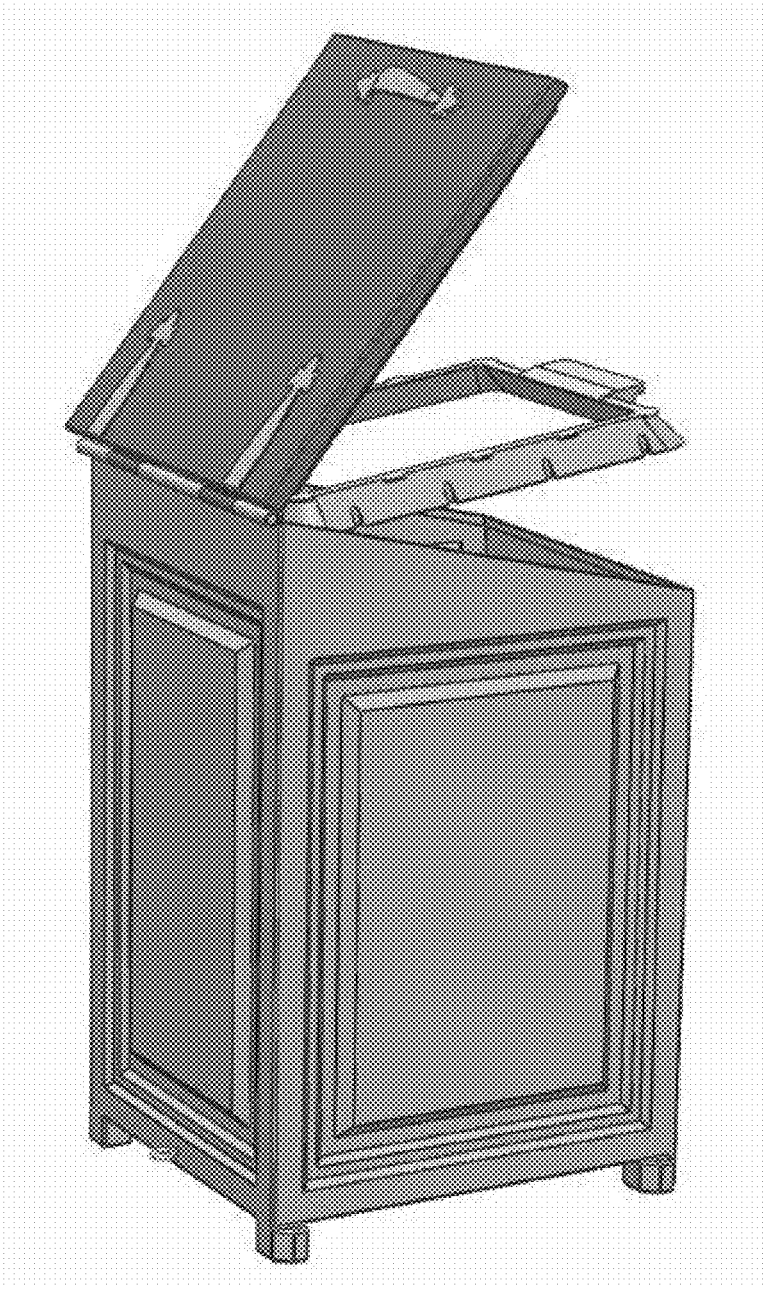
FIG. 15 is a back perspective view of yet another example of the present invention, in which the lid and bag holder are in open configurations.

In an example of the present invention, the lid may include hinge and/or handle details. As illustrated in FIGS. 1, 8, and 15, hinge details may be attached to the lid. The hinge details may be approximately aligned with the lid hinge brackets. The hinge details may be made of plastic, may be created through a molding process, and may be adhesively placed onto the lid, or the lid may be configured to receive the hinge details in a manner similar to the design details or motifs described above. The hinge details may also be attached to the lid by other means. A handle detail may be attached to the lid to allow for easily lifting of the lid into an open configuration. The handle detail may be adhesively placed onto the lid, or may be snapped into the lid in a manner similar to the design details described above. The handle detail may be attached by other means as well. The lid may be configured to receive the handle detail. The hinge and/or handle details may also be molded to the lid or assembled and/or attached afterwards. FIGS. 17A-B illustrate various examples of hinge details. FIGS. 18A-B illustrate various examples of handle details.

The present invention may also include placement of adhesive numbers onto a decorative area of the front wall. The font of the numbers may be compatible with the history of the home. In another example of the present invention, a standard set of numbers (i.e. 0 through 9) with adhesive backing is provided with the trash container. This may allow the container to be more easily and readily labeled for identification and personalization, while also keeping the aesthetic aspects of the container intact.

In another example of the present invention, one or more openings are included in the floor panel of the base which allow access from the interior of the base to the exterior. The floor panel may be, for instance, flat, convex/concave, multi-planar, or another shape. The openings may be positioned in a manner in which to be used as drainage holes, as shown in FIG. 6. Such drainage holes may allow for removal of liquid, such as water, waste, or small trash from the interior of the base. FIG. 6 illustrates a view of an example of the present invention in which the floor panel is angled and includes drainage holes at the lowest point of the angled floor panel. FIGS. 11 and 12 illustrate yet another example of the present invention, showing the floor and drainage holes.

In additional examples of the present invention, the opening(s) can be configured to include and receive a plug. When the plug is removed from the opening, the opening can be used as a drainage hole.

In additional examples of the present invention, the trash container is made up of multiple panels or walls assembled to form a base, and a lid. The base can be configured to include a removable front wall. The base may also be configured to receive the lid or wall through a hinge assembly as previously described.

Various examples of the present invention may be created by a molding process such as, but not limited to, rotational molding, injection molding, blow molding, or other means. The examples may also be created from various materials, including but not limited to plastic or metal. Each of the examples may also include the bag holder of the present invention.

In another example of the present invention, the base may be assembled by folding a single piece of plastic to create the walls of the base. The plastic may include grooves, indents, or preset folds to allow for assembly of a three-dimensional structure from a singular or multiple flat pieces.

The examples of the invention may include containers for indoor use. Examples of the invention may also include containers for commercial use.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claim to claim any and all applications, modifications, and variations that fall within the true scope of the present teachings.

The invention claimed is:

1. A trash container, said container comprising:

a front wall, left and right side walls, a back wall, and a floor panel, said walls and panel configured to create a base with an interior chamber;

a top opening to the interior chamber;

a lid connected to the base, said lid being configured to pivot into open or closed configurations;

one or more detachable motifs attached to one or more walls of the base, lid, or combinations thereof;

a bag holder configured within the top opening of the interior chamber and comprising one or more tabs extending from the bag holder;

a holder handle extending from the bag holder and configured to rest on the base; and a holder bracket extending from the bag holder and configured to connect to the base to allow the bag holder to pivot into open or closed configurations;

wherein the bag holder allows for a trash bag to be secured in the interior chamber and over the bag holder while the bag holder is in the open or closed configurations;

one or more feet extending from the base;

one or more bumpers extending from one or more feet;

one or more openings in the floor panel of the base wherein the floor panel is configured to allow drainage through the openings; and one or more molded openings, screws, or combinations thereof, for securing the container to a fixed location.

2. The container of claim 1 wherein the one or more motifs are attached to the front wall of the base.

3. The container of claim 1 comprising one or more hinge details attached to the lid.

4. The container of claim 1 comprising one or more handle details attached to the lid.

5. The container of claim 2 wherein the one or more motifs are interchangeable.

6. The container of claim 1, comprising one or more openings in the floor panel of the base wherein the floor panel is configured to allow drainage through the openings.

7. The container of claim 1 comprising one or more openings in the base for securing the container to a fixed location.

8. The container of claim 1 comprising one or more screws for securing the container to a fixed location.

9. A trash container comprising:

a base with an interior chamber;

a top opening to the interior chamber;

a lid connected to the base, said lid being configured to pivot into a closed configuration covering the opening to the interior chamber, or an open configuration allowing access to the interior chamber;

one or more feet extending from the base;

one or more bumpers extending from one or more feet;

a bag holder configured within the top opening of the interior chamber and comprising one or more tabs extending from the bag holder;

a holder handle extending from the bag holder and configured to rest on the base; and a holder bracket extending from the bag holder and configured to connect to the base to allow the bag holder to pivot into open or closed configurations;

wherein the bag holder allows for a trash bag to be secured in the interior chamber and over the bag holder while the bag holder is in the open or closed configurations;

one or more openings in the base configured to allow drainage through the openings; and one or more openings or screws for securing the container to a fixed location.

10. A trash container comprising:

a base with an interior chamber;

a top opening to the interior chamber;

a lid connected to the base, said lid configured to pivot into open or closed configurations;

one or more detachable motifs attached to the base;

one or more handle details, hinge details, or combinations thereof, attached to the lid;

a bag holder configured within the top opening of the interior chamber and comprising one or more tabs extending from the bag holder, wherein the bag holder is configured to pivot into open or closed configurations; and one or more bumpers attached to one or more feet of the base;

a floor panel of the base configured to allow for drainage through one or more openings in the floor panel;

a screw or molded opening for securing the container to a fixed location.

* * * * *